United States Patent [19]

Deutsch

[11] 4,223,583

[45] Sep. 23, 1980

[54] APPARATUS FOR PRODUCING MUSICAL TONES HAVING TIME VARIANT HARMONICS

[75] Inventor: Ralph Deutsch, Sherman Oaks, Calif.

[73] Assignee: Kawai Musical Instrument Mfg. Co., Ltd., Hamamatsu, Japan

[21] Appl. No.: 11,058

[22] Filed: Feb. 9, 1979

[51] Int. Cl.[2] ..... G10H 1/00; G10H 5/00

[52] U.S. Cl. ..... 84/1.01; 84/1.2; 84/1.22; 84/1.26

[58] Field of Search ..... 84/1.01, 1.11–1.13, 84/1.19, 1.2, 1.21, 1.22, 1.24, 1.26

[56] References Cited

U.S. PATENT DOCUMENTS

| | | | |
|---|---|---|---|
| 3,816,637 | 6/1974 | Whitefield | 84/1.24 |
| 4,012,982 | 3/1977 | Southard | 84/1.01 |
| 4,018,121 | 4/1977 | Chowning | 84/1.01 |
| 4,036,096 | 7/1977 | Tomisawa et al. | 84/1.01 |
| 4,067,254 | 1/1978 | Deutsch et al. | 84/1.01 |
| 4,082,027 | 4/1978 | Hiyoshi et al. | 84/1.01 |
| 4,119,005 | 10/1978 | Kondo et al. | 84/1.01 |
| 4,127,047 | 11/1978 | Tomisawa | 84/1.01 |
| 4,132,140 | 1/1979 | Chibana | 84/1.11 |
| 4,133,242 | 1/1979 | Nagai et al. | 84/1.13 |
| 4,135,427 | 1/1979 | Deutsch | 84/1.22 |
| 4,138,915 | 2/1979 | Nagai et al. | 84/1.22 |
| 4;142,432 | 3/1979 | Kameyama et al. | 84/1.01 |

*Primary Examiner*—S. J. Witkowski

*Attorney, Agent, or Firm*—Christie, Parker & Hale

[57] ABSTRACT

An electronic tone generator of a type in which an audio signal of controlled waveform is generated from a stored master data list of digitally coded words incorporates apparatus for changing the harmonic structure of the waveform with time during the generation of the audio signal. The master data list is computed by generating two data lists of words defining different waveforms and multiplying the two lists together repeatedly while shifting one list relative to the other list by at least one word. The resulting master data list changes with each multiplication following a shift, producing a changing waveform in which the musical frequencies are harmonically related, the waveshape being free of intermodulation distortion.

8 Claims, 9 Drawing Figures

FIRST DATA SET

APPARATUS FOR PRODUCING MUSICAL TONES HAVING TIME VARIANT HARMONICS

FIELD OF THE INVENTION

This invention relates to electronic musical instruments, and more particularly, is concerned with a tone generator in which the waveshape of the tone being generated varies with time.

BACKGROUND OF THE INVENTION

Most electronic instruments generate musical tones that have a constant spectral output. In contrast, most conventional musical instruments produce tones in which the spectral output varies with time. It is these changes in harmonic content of the tone being generated by a musical instrument which to a large measure gives the "natural" musical sound characteristic of the particular instrument. It is this lack of such time variations in the spectral content of the tone being generated that gives electronic musical instruments their "artificial" sound quality. To overcome this constant tone and to add interest and a more natural quality to the tone generated, various attempts have been made in electronic musical instruments to vary the harmonic content of the tone being generated by passing the musical waveshape through filters whose cutoff frequencies are caused to vary in a predetermined time variant manner. Filters of this type are referred to as formant filters. Copending application Ser. No. 857,436, filed Dec. 5, 1977, entitled "Resonator For a Musical Tone Synthesizer", now U.S. Pat. No. 4,175,463, by the same inventor as the present application, shows one such arrangement for producing a time variant effect. In copending application Ser. No. 866,336 filed Jan. 3, 1974, entitled "A Musical Generator With Time Variant Overtones", now U.S. Pat. No. 4,175,464, by the same inventor as the present application, frequency modulation of a carrier by modulating signals of equal or integral multiples of the carrier frequency is described. In U.S. Pat. No. 4,085,644 there is disclosed a polyphonic tone synthesizer in which a formant filter effect is implemented by varying the harmonic coefficients that are used in computing musical waveshapes from tables of harmonic coefficients.

SUMMARY OF THE INVENTION

The present invention is directed to an improved arrangement for generating an audio signal having a computed musical waveshape in which the harmonic structure is caused to vary in time in a controlled manner. This is accomplished without producing intermodulation distortion. More specifically, the controlled variation in computed waveshape is accomplished without producing musical frequencies which are not harmonically related to the fundamental of the note being generated and without increasing or decreasing the number of harmonics present in the musical tone being generated.

In brief, the present invention is directed to a digital tone generator in which the waveshape of the tone is determined by converting a series of digital values, either computed in real time or read out of storage, to an analog voltage of the desired waveshape. By the present invention two digital words from two sets of computed or stored waveforms are multiplied together to produce each of the series of digital values that are converted to an analog voltage. By shifting the relative phase between the two sets of waveforms with time, the resulting products forming the series of digital values are also modified with time. The resulting analog voltage has a waveshape that changes with time in a predictable controlled manner.

BRIEF DESCRIPTION OF THE DRAWINGS

For a better understanding of the invention, reference should be made to the accompanying drawings wherein:

FIG. 1 is a schematic block diagram of one embodiment of the present invention;

DETAILED DESCRIPTION

Figure 2:
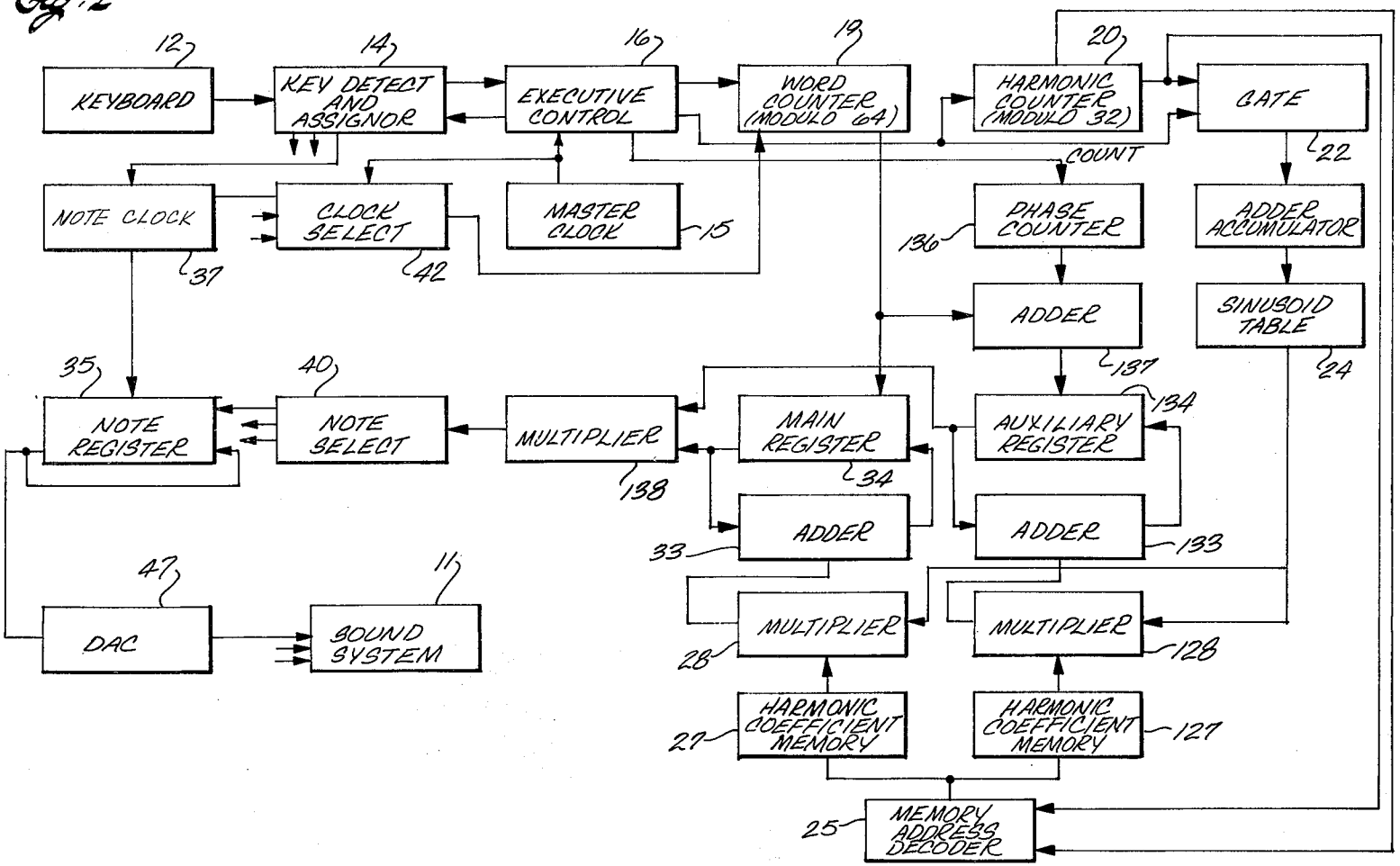
FIG. 2 is a spectral plot of a first set of harmonic coefficients.
Figure 2:
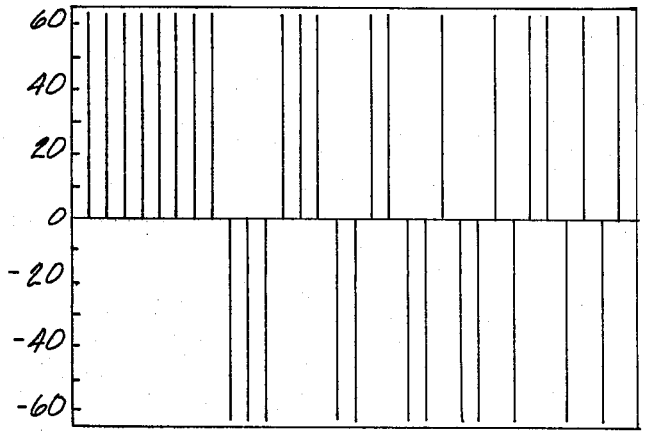

The preferred embodiment of the present invention as described in FIG. 1 is a modification to the polyphonic tone synthesizer described in U.S. Pat. No. 4,085,644, hereby incorporated by reference. The two-digit reference characters in FIG. 1 identify the same elements as are described in the referenced patent. In the polyphonic tone synthesizer musical tones are generated by first computing a master data list of words corresponding to the amplitudes of a fixed number of equally-spaced points defining one cycle of the musical waveshape. Each word is computed by adding the amplitudes of corresponding points on each of the 32 harmonics used to define the tonal harmonic structure of the tone being generated. The stored values of a selected set of harmonic coefficients is multiplied with a set of sinusoid values from a sinusoid table for computing the set of points defining each harmonic of the waveshape being computed. The master data list has a fixed number of words which is at least twice the number of harmonics used in the computation. A musical tone is generated from the master data list by transferring the words in sequence to a digital-to-analog converter at a rate proportional to the desired pitch of the note being generated.

The present invention is directed to an arrangement for producing musical tones having time variant harmonics and utilizes the concept of amplitude modulation. In effect, two signals having the same fundamental frequency and with the same number of harmonics but with different waveshapes are multiplied together to produce a resultant signal which still has the same fundamental frequency and the same number of harmonics. By changing the phase relationship between the two signals before they are multiplied, the harmonic coefficients of the harmonics of the resultant signal can be varied in a controlled manner.

Referring to FIG. 1 in detail, separate data lists representing two different signal waveshapes are computed simultaneously in two registers or memories, a main register 34 and an auxiliary register 134. Each of the data lists is computed in exactly the same manner as the master data list described in the above-identified U.S. patent, but with one exception. A full set of 64 data words, representing a full cycle of the waveshape, is computed and stored in the registers 34 and 134 rather than the 32 words or half a cycle computed and stored in the main register 34 described in the above-identified U.S. patent. To this end, the word counter 19 of the patent is modified to be modulo 64 instead of modulo 32.

A computation cycle is initiated by the executive control 16 which starts the word counter 19 counting up in response to logic clocks from a master clock 15. The word counter 19 is used to address a sinusoid table 24, the output of which is applied to a multiplier 28 which multiplies the sinusoid value with a harmonic coefficient value from a harmonic memory 27. The harmonic memory 27 is addressed by harmonic counter 20. The output of the multiplier 28 is added to a word in the main register 34 by means of an adder 33 and rewritten in the main register. The main register 34 is addressed sequentially by the word counter 19. By this iterative process, as explained in detail in the above-identified patent, a master data list consisting of 64 words is stored in the main register 34. The 64 words represent digitally the amplitudes of 64 equally spaced points defining one complete cycle of an audio signal having a predetermined waveshape. When the master data list is transferred to a note register in one of the tone generators, such as the note register 35, and then transferred word-by-word to a digital-to-analog converter 47 at a rate determined by the pitch of the note being generated, the resulting analog signal has the desired waveshape. The fundamental pitch is controlled by a note clock 37 whose frequency is determined by a key operated on the keyboard 12 and stored in the note detect and assignor circuit 14. See U.S. Pat. No. 4,022,098.

To provide time variant harmonics which modify the waveshape of the tone being generated as the tone is sounded, the sinusoid value from the table 24 is applied to one input of a second multiplier 128. The other input to the multiplier 128 is a coefficient value from a second harmonic memory 127. Again the output of the multiplier 128, like the output of the multiplier 28, is added to a word read out of the auxiliary register 134, by means of an adder 133, and then written back into the auxiliary register 134. Thus a second data set of 64 words is computed and loaded in auxiliary register 134 at the same time the data list is being computed and stored in the main register 34. The data list in the auxiliary register 134 corresponds to a waveshape having harmonics of different coefficient values, as represented by the different coefficient values stored in the harmonic memory 127 from those stored in the harmonic memory 27.

During the transfer mode of operation in which the data list in the main memory register 34 is transferred to a note register in one of the tone generators, such as the note register 35 as selected by note select circuit 40, the data list is modified by multiplying each word from main register 34 by a word from the auxiliary register 134 with the product being stored as one word in the note register 35. Thus at the end of the transfer operation, the note register stores 64 words, each word being the product of a pair of words from the respective data lists in the main register 34 and the auxiliary register 134. By combining the waveforms defined by the two data lists by a multiplier, a new waveform is generated which contains harmonics not necessarily present in either of the computed waveshapes within the 32 harmonics limitation imposed by the 64 points defining one cycle.

To produce the time variant harmonic effect, the phase of the data list read out of the auxiliary register 134 is shifted periodically or in some other predetermined manner as a function of time relative to the data list in the main register 34, so that the pairs of words applied to the multiplier change with time. This is accomplished in the arrangement shown in FIG. 1 by modifying the address in the word counter 19 as applied to the auxiliary register 134 relative to the address applied to the main register 34. This may get redone periodically by a phase counter 136 whose count status is added by an adder 137 to the address from the word counter 19. The phase counter 136 is advanced by one count, for example, following each transfer cycle initiated by the executive control 16. Thus each time a transfer from the registers 34 and 134 to the note register 35 takes place the phase of the data list as read out of the register 134 is shifted one word relative to the data list read out of the main register 34. With the phase counter 136 initially set to zero, the word counter addresses the same word positions in both registers when reading out a pair of words to the multiplier 138. During the next successive transfer, with phase counter 136 counted up 1, word counter 19 addresses the word position one word down in the list compared to the word position addressed in the main register.

Figure 3:
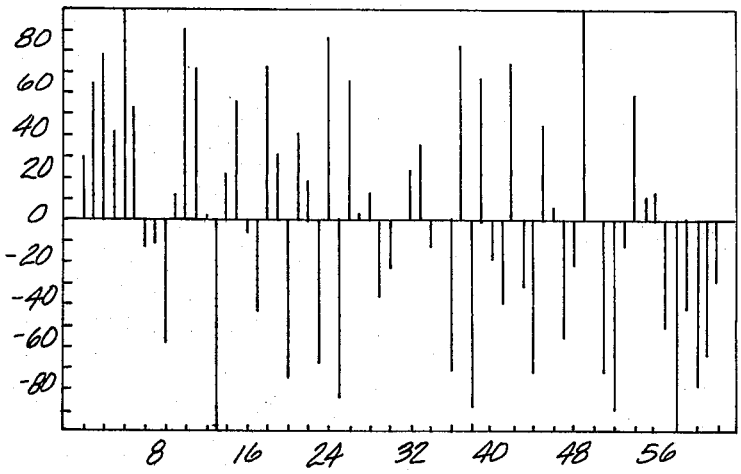
FIG. 3 is a plot of a data set computed from the coefficients of FIG. 2.
Figure 4:
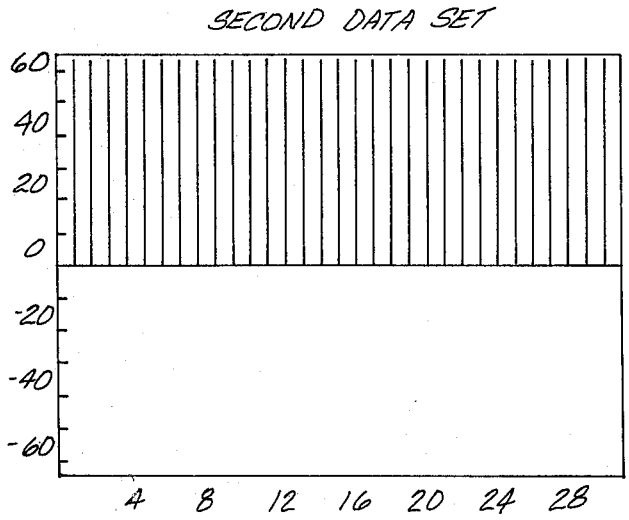
FIG. 4 is a spectral plot of a second set of harmonic coefficients.
Figure 5:
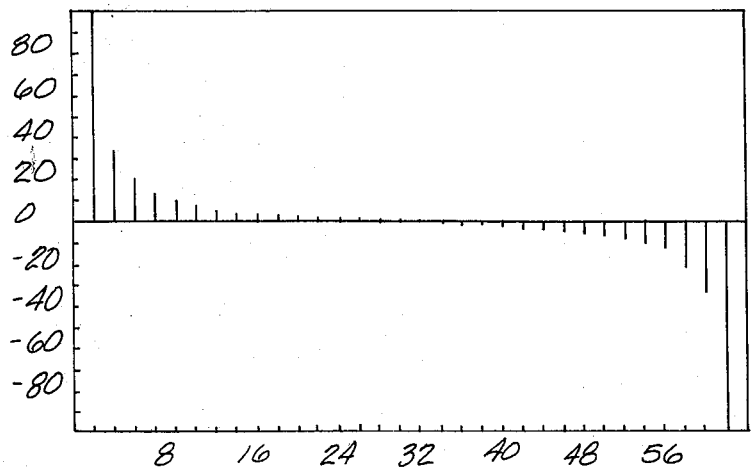
FIG. 5 is a plot of a data set computed from the coefficients of FIG. 2.

While there are no limitations on the sets of harmonic coefficients which can be used in the memories 27 and 127, it has been found advantageous in generating musical tones to have the data set in the master register contain data with no pronounced single peaks while the data set in the auxiliary register should have a single pulse-like waveshape. The smooth condition of the data set computed and stored in the main register 34 can be obtained by using positive and negative coefficient values, as described in the above-identified patent. The peak condition desirable for the master data set and the auxiliary register can be obtained by using all positive or all negative coefficient values. An example of a set of coefficient values for the data set computed in the main register 34 is shown in FIG. 2. As illustrated, the coefficients for each of the 32 harmonics are of equal magnitude, namely, 63 units of amplitude with the algebraic sign of the respective coefficients corresponding to the table of phase constants listed in the above-identified patent, namely, 0,0,0,0,0,0,0,0,1,1,1,0,0,0,1,1,0,0,1,1,0,-1,0,1,0,0,1,0,1,0,1, where 0 represents a positive value and 1 represents a negative value. The resulting set of computed points in the data set is shown in FIG. 3. FIG 4 is similar to FIG. 2 but showing the coefficient values for the second data set in which the coefficients are all of equal value, namely, 63 units of amplitude, and all of the same algebraic sign. FIG. 5 shows the 64 computed values in the auxiliary register 134 using the coefficient values of FIG. 4. It will be noted that the only difference between the two sets of coefficient values is in the fact that the algebraic sign is reversed for some of the harmonic coefficients in the first set, resulting in a substantially different set of computed values in the two sets. It will be noted that in FIG. 5, the waveform peaks at each end of the cycle, giving it a pronounced pulse-like form. It is interesting to note that although FIGS. 3 and 5 differ substantially in waveshape, the resulting audio tones produced by the two waveforms sound the same to the human ear since the ear is not sensitive to the phase of the respective harmonics but only to the number of harmonics and their amplitudes, which are the same for both waveforms.

Figure 6:
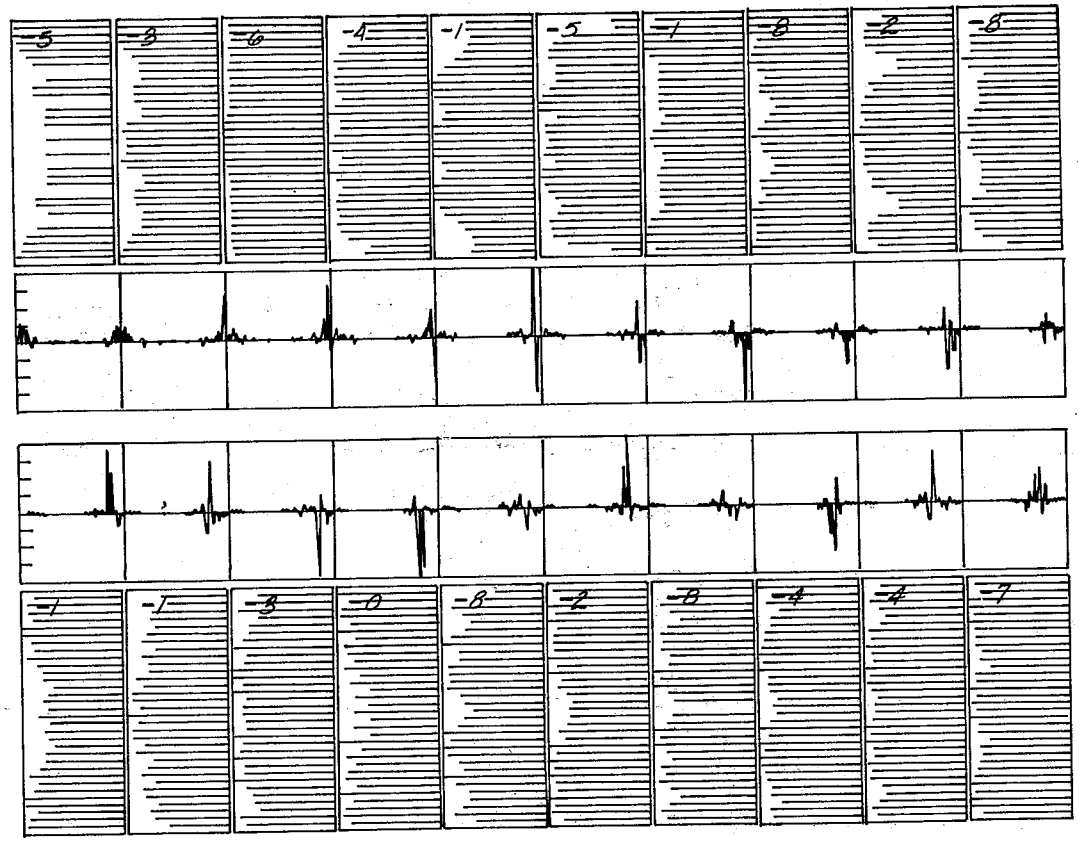
FIG. 6 is a series of waveforms and associated spectrum resulting from multiplying the data sets of FIG. 3 and FIG. 5 together with progressive phase shifts.

FIG. 6 shows the waveform resulting from the multiplication of waveforms of FIGS. 3 and 5 as stored in the note shift register 35. The waveshape is plotted in analog form. The successive cycles of the waveform correspond to shifting of the phase of the waveshape data as read out of the registers 34 and 134. Starting with the upper left block of the waveshapes in FIG. 6, the first block corresponds to no phase difference in the readout from the two registers. Each succeeding waveshape corresponds to a change in address of 1,2,3, . . . units. Plotted adjacent to each waveshape is the corresponding spectral plot of the relative amplitude of the 32 harmonics. It is apparent that the multiplication and phase shift provides spectral changes having a wide variety of waveforms.

Figure 7:
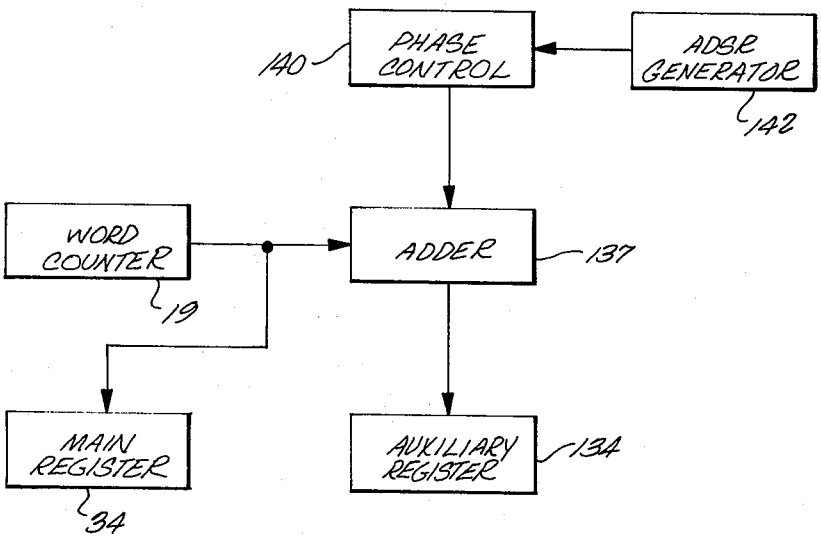
FIG. 7 is a modification to the phase control of FIG. 1.

It should be noted that the manner in which the phase is varied between the waveshape represented by the two sets of data in the registers 34 and 134 can take a variety of other forms. For example, the phase counter 136 could be counted at some predetermined clock rate. Also, rather than using a counter to modify the address to the adder 137, some other type of control signal, such as the output of an ADSR generator, could be used. Thus as shown in FIG. 7, the output of an ADSR generator 142 is applied to a phase control circuit 140 which converts the control signal from the ADSR generator to a digital form which can be added to the output of the word counter 19 and the adder 137 for addressing the output of the register 134 in a controlled manner relative to the addressing of the main register 34. A suitable ADSR generator is described, for example, in U.S. Pat. No. 4,079,650, hereby incorporated by reference. In this way the phase shift and resulting change in waveshape of the tone generator can be synchronized with the attack and decay of the tone being generated.

It will be evident that by splitting the computation cycle into two phases, one phase for computing the data list in the main register 34 and another phase to compute the data list in the auxiliary register 134, a single adder and multiplier can be time shared for the two computation phases. Likewise, because the multiplier 138 is used during the transfer operation while the multipliers 28 and 128 are used during the computation, a single multiplier could be time shared for these two functions.

Figure 8:
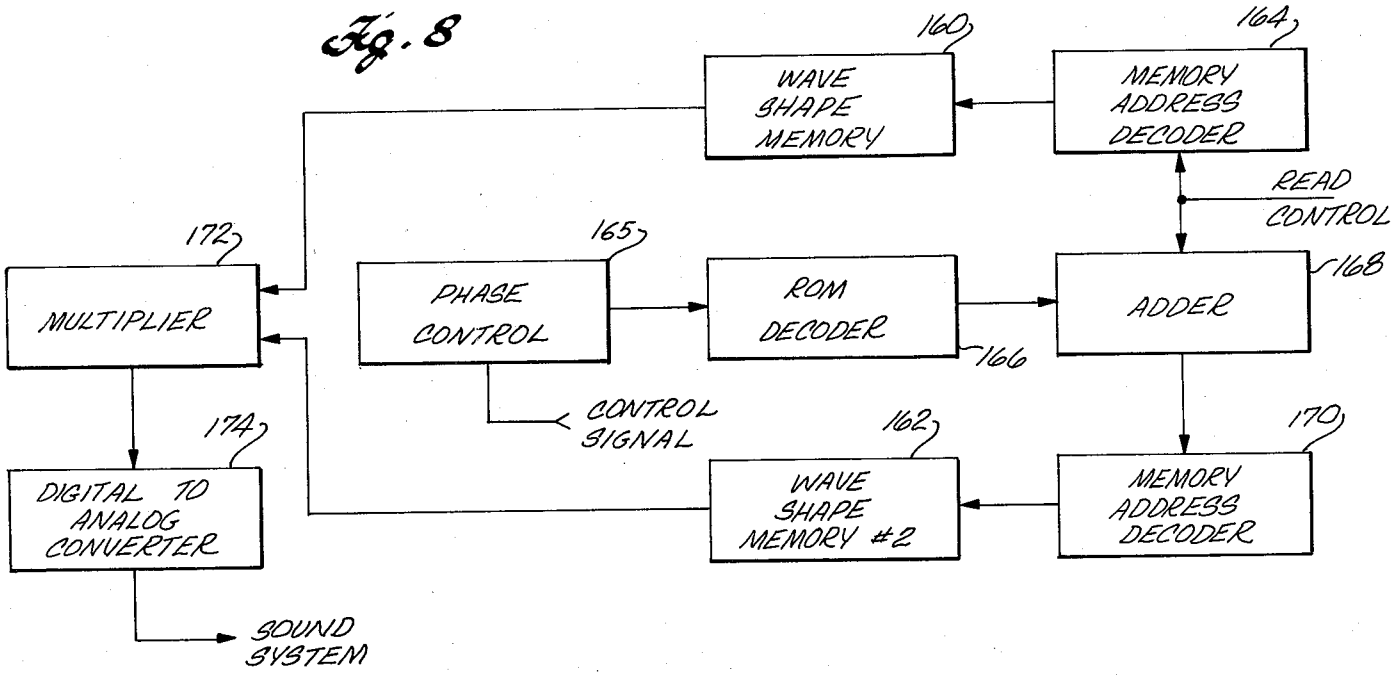
FIG. 8 is a schematic diagram of another embodiment of the present invention.

FIG. 8 is a schematic block diagram of the present invention as applied to a musical tone system of the type described in U.S. Pat. No. 3,515,792 entitled "Digital Organ", hereby incorporated by reference. In the digital organ, musical waveshapes are stored in digital form in a waveshape memory. According to the present invention two waveshapes, such as those defined by the amplitude values plotted in FIGS. 3 and 5, respectively, are stored in two separate waveshape memories 160 and 162, designated waveshape memory #1 and waveshape memory #2. The digital data in memory #1 is addressed by a recycling read control through a memory address decoder 164 in the manner described in the above-identified patent. The read control, by means of the memory address decoder 164, addresses and reads out repetitiously the stored digital representation of the waveshape one word at a time at a rate corresponding to the clock signal generated in response to the operation of a key on the keyboard. A phase control circuit 165 in conjunction with a ROM decoder 166 provides a phase control number to an adder 168. The output of the adder is applied as an address to a memory address decoder 170 which decodes the address word from the adder and addresses a corresponding location in the waveshape memory #2. As a result, the waveshape data read out of waveshape memory #2 is different from that read out from waveshape memory #1. The pair of output data words from the two waveshape memories with each Read cycle are multiplied together by a multiplier 172. The product data words are applied word by word at the note clock rate to the digital-to-analog converter 174 to convert the data to an analog voltage for driving the audio sound system. The relative phase between the waveshape data read out of the two memories is controlled in any suitable manner as a function of time by means of a control signal applied to the phase control circuit 165.

Figure 9:
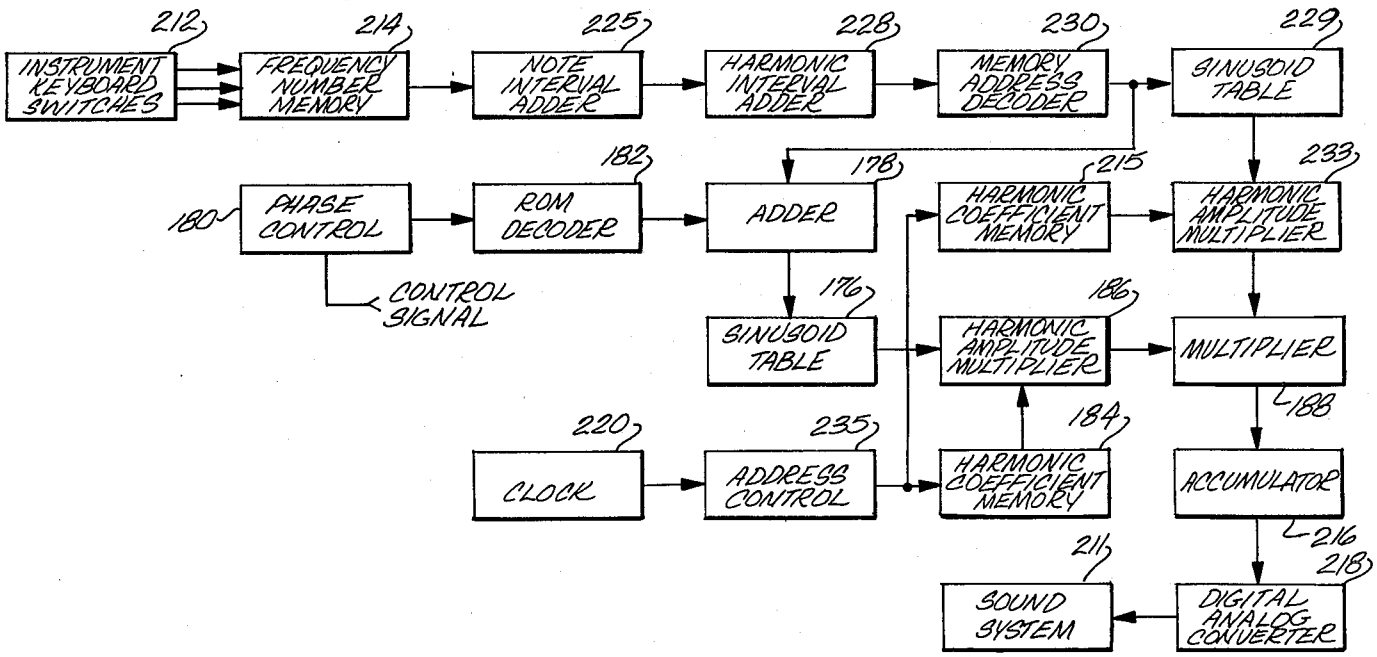
FIG. 9 is a schematic block diagram of yet another embodiment of the present invention.

FIG. 9 is a schematic block diagram of the present invention as applied to the computer organ described in detail in U.S. Pat. No. 3,809,786, hereby incorporated by reference. In FIG. 9, all 200 series reference characters identify circuit elements which are identical to those described in the patent and have the same two lower order digits in the associated reference characters. Thus the instrument keyboard switches 212, corresponding to instrument switches 12 in the patent, select a frequency number R from a frequency number memory 214. The note interval adder 225 keeps adding the R number to itself q times providing an output qR to the harmonic interval adder 228. The output of the note interval adder 225 is applied to a harmonic interval adder 228 which adds the input to the accumulated value in the adder, producing an output NqR which is used to address a sinusoid table 229 by means of a memory address decoder 230. The output of the sinusoid table is multiplied with the output of a coefficient from the harmonic coefficient memory 215 by means of a harmonic amplitude multiplier 233, all in the manner described in detail in the above-identified U.S. Pat. No. 3,809,786.

According to the present invention, the output of the memory address decoder 230 is used to address a second sinusoid table 176 through an adder 178. The adder modifies the address by a predetermined amount as determined by a phase control circuit 180 and ROM decoder 182. The output of the sinusoid table 176 is multiplied with the coefficient value from a harmonic coefficient memory 184 by a harmonic amplitude multiplier 186. Both the harmonic coefficient memories 184 and 215 are addressed sequentially by a clock 220 and address control 235. The computed word from the multiplier 186 is multiplied with the computed word from the multiplier 233 by the multiplier 188, with the product being applied to the accumulator 216. The phase control provides a phase control signal to the adder in the same manner as described above in connection with FIGS. 6 and 7. Thus the output applied from the accumulator to the digital-to-analog converter 218 is the product of two sets of data corresponding to two different waveshapes whose phase is controlled as a function of time. The analog output signal having the desired waveshape is applied to the sound system 211.

What is claimed is:

1. A polyphonic tone synthesizer comprising: means for storing a master data set of digital values defining a musical waveshape, digital-to-analog converter, means transferring each of said values in sequence, at a sequential rate proprotional to the fundamental pitch of the tone, to said converter, and means for generating such digital values in the master data set including means generating and storing a first set of digitally coded values, means generating and storing a second set of values, means multiplying together and storing the products of pairs of values taken in sequence respectively from said first and second sets of values to form said master data set, and means for shifting the values in the second set relative to the values in the first set to change the pairing of the values from the two sets that are multiplied together.

2. Apparatus of claim 1 further including control means for shifting the time relationship in a predetermined manner as a function of time.

3. Apparatus of claim 2 wherein said control means includes means for periodically shifting the pairing of successive words in the two sets by one word, whereby the relative phase between the two sets, as applied to the means multiplying pairs of values from the two sets, is shifted by one word at fixed time intervals.

4. In an electronic musical instrument, apparatus for producing an audio signal whose waveshape varies with time in a predetermined manner, comprising: means for generating a first succession of coded words corresponding to the amplitude of points defining a first periodic waveshape, means for simultaneously generating a second succession of coded words corresponding to the amplitude of points defining a second periodic waveshape, each word of the first succession being generated at the same time as a word in the second succession to form successive pairs of words, multiplying means for multiplying the value of each coded word in said first succession with the paired word in said second succession for providing a succession of resultant words each of which corresponds in coded value to the product of a pair of words from said first and second succession of words, digital-to-analog converter means for converting the succession of resultant words to an analog voltage and means for shifting the time relation between the first and second succession of words to change the pairing of successive words applied to the multiplying means.

5. Apparatus of claim 4 further including control means for shifting the time relationship in a predetermined manner as a function of time.

6. Apparatus of claim 5 wherein said control means includes an ADSR generator controlling the peak amplitude of the analog voltage from the converter as a function of time, whereby the relative time relation between the first and second succession of words changes with the change in peak amplitude of the analog voltage from the converter.

7. Apparatus of claim 4 wherein the means generating the first and second succession of words includes memory means for storing two groups of words defining the two waveshapes, and means for transferring words from the two groups a pair at a time to the multiplying means.

8. Apparatus of claim 7 wherein successive pairs of words are transferred from the memory means to the multiplying means at a rate proportional to the pitch of the musical tone being generated.

* * * * *